US006736223B2

(12) United States Patent
Odell, II et al.

(10) Patent No.: US 6,736,223 B2
(45) Date of Patent: May 18, 2004

(54) THRUST CONTROL APPARATUS

(75) Inventors: Albert C. Odell, II, Kingwood, TX (US); Jay M. Eppink, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 42 days.

(21) Appl. No.: 10/006,877

(22) Filed: Dec. 5, 2001

(65) Prior Publication Data

US 2003/0102164 A1 Jun. 5, 2003

(51) Int. Cl.[7] ..... E21B 7/00

(52) U.S. Cl. ..... 175/57; 175/51; 175/299; 175/321

(58) Field of Search ..... 175/51, 57, 293, 175/299, 304, 321, 322

(56) References Cited

U.S. PATENT DOCUMENTS

| | | | | |
|---|---|---|---|---|
| 2,570,577 A | | 10/1951 | Manion | 255/28 |
| 3,033,011 A | | 5/1962 | Garrett | 64/11 |
| 3,099,918 A | | 8/1963 | Garrett | 64/27 |
| 3,122,902 A | | 3/1964 | Blair et al. | 64/23 |
| 3,180,437 A | | 4/1965 | Keller et al. | 175/230 |
| 3,230,740 A | | 1/1966 | Fox | 64/23 |
| 3,254,508 A | | 6/1966 | Garrett | 64/1 |
| 3,301,009 A | | 1/1967 | Coulter, Jr. | 64/23 |
| 3,339,380 A | | 9/1967 | Fox | 64/23 |
| 3,447,340 A | | 6/1969 | Garrett | 64/1 |
| 3,871,193 A | | 3/1975 | Young | 64/23 |
| 4,162,619 A | | 7/1979 | Nixon, Jr. | 64/23 |
| 4,194,582 A | | 3/1980 | Ostertag | 175/321 |
| 4,207,756 A | * | 6/1980 | Toelke | 175/321 |
| 4,254,837 A | | 3/1981 | Jones | 175/67 |
| 4,434,863 A | | 3/1984 | Garrett | 175/321 |
| 4,466,496 A | | 8/1984 | Jones | 175/67 |
| 5,560,241 A | | 10/1996 | Satoh et al. | 72/467 |
| 5,662,180 A | * | 9/1997 | Coffman et al. | 175/57 |
| 6,003,606 A | | 12/1999 | Moore et al. | 166/381 |
| 6,230,813 B1 | * | 5/2001 | Moore et al. | 166/381 |

* cited by examiner

*Primary Examiner*—Zakiya Walker
(74) *Attorney, Agent, or Firm*—Conley Rose, P.C.

(57) ABSTRACT

A thrust absorber is interposed between a thruster and an anchor that cooperate to axially displace another member. The thrust absorber includes an enclosure fixed to the anchor and a retainer connected to the thruster. A biasing member is operably associated with the retainer. During an overthrust condition, the thruster imparts a thrust force to the member, but the member is not substantially axially displaced. In such a condition, the biasing member absorbs the thrust that the thruster would otherwise impart to the member. A dampener is also included to dampen the movement of the thruster and anchor when the anchor is no longer anchoring the thruster.

42 Claims, 8 Drawing Sheets

THRUST CONTROL APPARATUS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to downhole tools that control thrust generating members. More particularly, the present invention relates to an apparatus that absorbs the thrust generated by a downhole tool having a mud motor and/or a propulsion system.

2. Description of the Related Art

It is known that the recovery of subterranean deposits of hydrocarbons requires the construction of wells having boreholes hundreds, perhaps thousands, of feet in depth. One known system configured for well construction activities includes a bottom hole assembly (BHA) that is tethered to surface support equipment by a flexible umbilical. This BHA may be a self-propelled system that forms a borehole using a bit adapted to disintegrate the earth and rock of a subterranean formation. One such system is described in U.S. Pat. No. 6,296,066, entitled "Well System," issued Oct. 2, 2001, hereby incorporated herein by reference for all purposes. This system preferably includes a bit, a downhole means to rotate the bit, and a downhole means to thrust the bit against the bottom of the borehole. An exemplary arrangement utilizes a positive displacement motor (e.g., a "mud motor") to rotate the bit and a tractor to generate thrust or weight on bit (WOB). In these systems, high pressure drilling mud is conveyed to the BHA through the umbilical. After passing through the BHA, the drilling mud exits through nozzles located in the bit and the drilling mud with returns flows back to the surface via an annulus formed between the umbilical and the borehole wall. The mud motor and tractor use the drilling fluid flowing through the umbilical as their power source.

A system wherein two or more components share a common hydraulic fluid supply have certain drawbacks. Referring now to FIG. 1, there is schematically shown an exemplary hydraulic circuit that is susceptible to these drawbacks. The hydraulic circuit includes a fluid line 10, a tractor 11 having a pressure chamber 12 and piston head 13, a mud motor 14 having a power section 18 that includes a rotor 15, a stator 19, and a bit 16. Drilling fluid flows through fluid line 10 and mud motor 14 to bit 16. A portion of the drilling fluid is diverted via line 17 to tractor 11. When drilling fluid enters pressure chamber 12, piston head 13 drives bit 16 into the formation. The drilling fluid flowing through mud motor 14 induces rotation of power-section rotor 15 and connected bit 16. Thus, mud motor 14 uses the pressure differential across power-section rotor 15 to induce bit 16 to rotate whereas tractor 11 uses the pressure in chamber 12 to drive piston head 13 and bit 16 into the formation.

Because tractor 11 and mud motor 14 draw from a common hydraulic fluid line 10, an unstable operating condition in mud motor 14 may cause a corresponding instability in tractor 11, and vice versa. For example, during drilling operations, the BHA may encounter a formation having earth and rock that is particularly difficult to disintegrate. A bit 16 forced against this hard to drill formation tends to increase the torque required to turn the drill bit against the formation. The bit torque increase causes a resultant increase in the differential pressure across power section 18 of mud motor 14. As the pressure differential across mud motor 14 increases, the pressure of the drilling fluid in fluid line 10 upstream of mud motor 14 also increases. Tractor 11 receives this higher pressure drilling fluid from line 17 which is connected to fluid line 10. Because drilling fluid pressure and tractor thrust are directly related, this increased pressure causes tractor 11 to drive the bit 16 even harder against the formation and at a faster rate. This increase in tractor rate of advancement further contributes to the increase in the torque required to turn the bit 16, thereby creating a feed-back effect which may ultimately cause the bit to stall or shorten the operating life of BHA components such as mud motor 14.

Some systems incorporate shock absorbers or dampeners in BHAs just above the mud motors. These shock absorbers or dampeners are sometimes Belleville springs that reduce the spring rate of the BHA between the motor and the tools above. However, having the springs just above the mud motors increases the length of the drillstring and also requires extra connections. An additional spline for transmitting torque load is also required. Additionally, the tractor still pushes the bit by weight on bit and can have the same problems discussed above. The tractor, having dampeners on each anchor allows for each dampener to be reset whenever its anchor disengages the hole wall so that additional length of dampening movement can allow tractor rate of advancement to slow down to drilling rate. Also directional control ability of drill bit below is reduced due to lower bending rigidity, and also circumferential looseness of spline connections.

The present invention addresses these and related deficiencies in prior art systems discussed above.

SUMMARY OF THE INVENTION

The present invention features a thrust absorber interposed between a thrusting means and an anchoring means. Normally, the thrusting means and the anchoring means cooperate to axially displace a tube. In a preferred embodiment, the thrust absorber includes an enclosure that is fixed to the anchoring means and a retainer connecting to the thrusting means. Disposed within the enclosure is a biasing member that is configured to absorb thrust energy when a predetermined condition occurs. Particularly, the thrusting means can encounter an overthrust condition when the thrusting means imparts a thrust force to the tube, but the tube is not substantially axially displaced. When an overthrust condition occurs, the biasing member is compressed by the tube, and thereby absorbs the thrust that otherwise would have been imparted to the tube. Also, by absorbing the thrust, the pressure increase is substantially reduced. The reduction in pressure increase reduces the tractor advancement rate increase so that the tractor rate is modulated and makes the system more stable. Furthermore, for a bottom hole assembly having more than one thrusting means, a thrust absorber may be provided for each such thrusting means.

In a first and second alternative embodiment, the thrust absorbers additionally comprise two different configurations that restrict the speed of movement of the thrust absorbers. The thrust absorbers are especially restricted once the external load across the absorber is relaxed.

In a third alternative embodiment, the thrust absorber additionally comprises a second biasing member disposed within the enclosure. Particularly, the second biasing member restricts movement of the thrust absorber when the tube is displaced in a direction opposite that of the intended forward direction of the tractor. The second biasing member allows most of the length of the thruster stroke to be realized by preventing loss of stroke length due to movement of the thrust absorber.

The present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the present invention, reference will now be made to the accompanying drawings, wherein.

DETAILED DESCRIPTION OF THE PREFERRED EMBODIMENT

While the present invention may be used in a variety of situations, a preferred embodiment of the present invention may be used in conjunction with a well tool adapted to form a well bore in an subterranean formation. It should be appreciated, however, that the below-described arrangement is merely one of many for which the present application may be advantageously applied.

Figure 1:
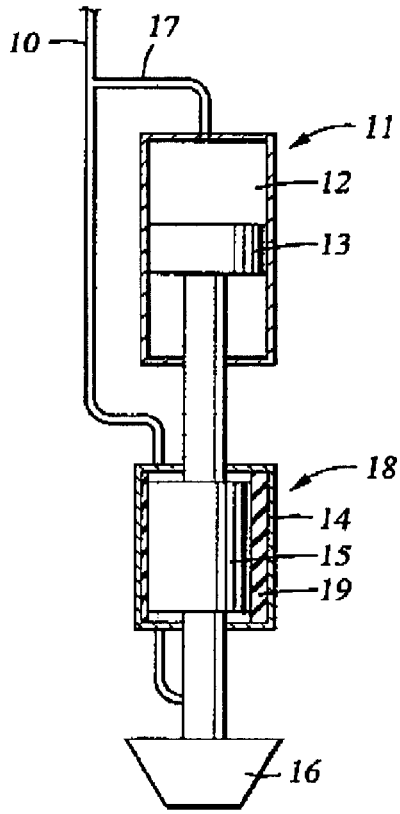
Fig. 1 (PRIOR ART)
FIG. 1 is a schematic diagram of a prior art hydraulic circuit that includes a tractor, a mud motor, and a bit constructed in accordance with a preferred embodiment.
Figure 2:
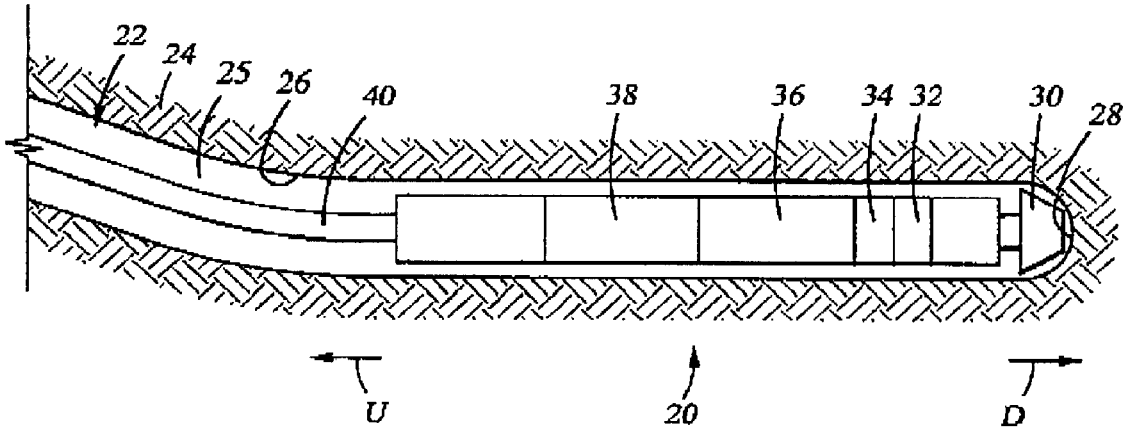
FIG. 2 is a schematic diagram of a bottom hole assembly constructed in accordance with the preferred embodiment disposed in a well bore.

Referring initially to FIG. 2, a bottom hole assembly (BHA) 20 is shown disposed in a well bore 22 formed in a formation 24, the well bore 22 having a wall 26 and a well bottom 28. Arrangements for exemplary BHA's are discussed in U.S. Pat. No. 6,296,066, issued Oct. 2, 2001, entitled "Well System", and in U.S. patent application Ser. No. 09/467,588 filed Dec. 20, 1999 entitled "Three Dimensional Steering System", both hereby incorporated herein by reference for all purposes. BHA 20 may include a bit 30, instrumentation 32, a mud motor 34, a tractor 36, and other auxiliary equipment 38, such as telemetry systems or data processors. An umbilical 40 connects BHA 20 to the surface. For convenience, movement of BHA 20, or any of its components, in direction "D" is intended to denote movement of BHA 20 towards well bottom 28 (downhole). Movement of BHA 20, or any of its components, in direction "U" is intended to denote movement of BHA 20 away from well bottom 28 (uphole).

The various devices and mechanisms of BHA 20 may be energized using high pressure drilling fluid (i.e., "mud") pumped from the surface through umbilical 40. Under ordinary operations, this drilling fluid flows through the umbilical 40, through BHA 20, and exits at bit 30 through nozzles (not shown). The drilling fluid returns uphole through the annulus 25 formed by well bore wall 26 and umbilical 40 and carries with it the cuttings of earth and rock that have been created by the cutting action of bit 30 against well bottom 28. Drilling mud pumped downhole is normally under very high pressure. This high pressure can be converted into energy by BHA 20 components, such as the tractor 36 and mud motor 34, that use hydraulically actuated mechanisms.

Figure 3A:
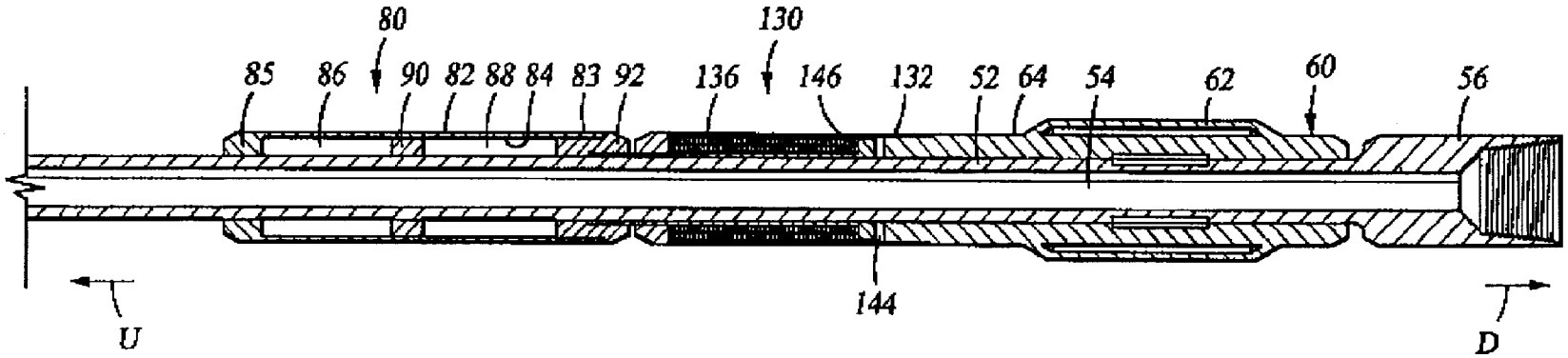
FIG. 3A is a cross-sectional view of a tractor incorporating a forward thrust controller constructed in accordance with the preferred embodiment.
Figure 3B:
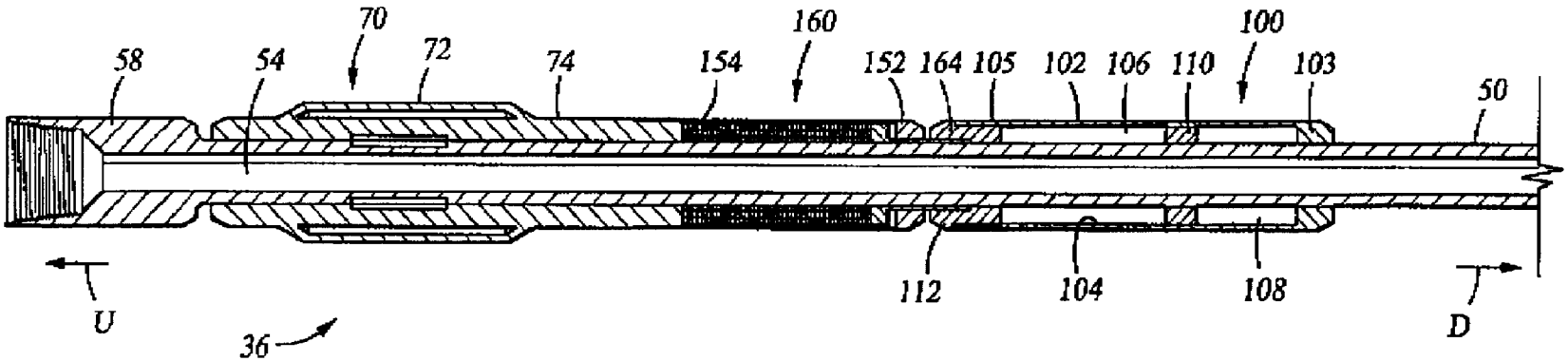
FIG. 3B is a cross-sectional view of a tractor incorporating an aft thrust controller constructed in accordance with the preferred embodiment.

Referring now to FIGS. 2, 3A and 3B, there is shown a preferred arrangement of forward and aft thrust controllers 130, 160 mounted on each end of tractor 36. Tractor 36 is configured to convert the hydraulic pressure of the drilling fluid into a thrusting force for urging bit 30 against well bottom 28 (FIG. 2). The thrust developed by tractor 36 is controlled by a forward thrust controller 130 and an aft thrust controller 160. The details of tractor 36, the valve control circuitry (not shown) and other related mechanisms are discussed in U.S. Pat. No. 6,003,606 Puller-Thruster Downhole Tool, hereby incorporated herein by reference for all purposes. Tractor arrangements are also disclosed in U.S. Pat. No. 3,180,437, also hereby incorporated herein by reference for all purposes. Accordingly, only general reference will be made to the structure and operation of tractor 36.

A exemplary tractor 36 may include a forward anchor 60, an aft anchor 70, a forward thruster 80 and an aft thruster 100, all disposed on a mandrel or center tube 50. These components are energized using high pressure drilling fluid that is directed through tractor 36 by valve circuitry (not shown) and associated piping (not shown). The valve circuitry and associated piping will be referred to generally as valve circuitry hereinafter. Valve circuitry can be programmed to cause tractor 36 to deliver a thrust force to bit 30 and/or propel BHA 20 through well bore 22 (FIG. 2).

Tube 50 transmits the thrust generated by forward and aft thrusters 80, 100 to bit 30. Tube 50 includes a medial portion 52 and first and second end portions 56, 58 and with a flowbore 54 extending therethrough. First and second end portions 56, 58 include connection interfaces for adjacent components in the bottom hole assembly 20. For example, first end portion 56 may link tractor 36 with mud motor 34. Second end portion 58 may link tractor 36 with auxiliary equipment 38. Flowbore 54 provides a channel for conveying drilling fluid through tractor 36 to bit 30. Tube medial portion 52 telescopically reciprocates within tractor 36 as forward and aft thrusters 80, 100 alternately deliver their respective thrust forces to tube 50 in a manner described below.

Forward anchor 60 holds forward thruster assembly 80 stationary relative to borehole wall 26 while forward thruster 80 urges tube 50 and aft thruster assembly 100 downhole towards well bottom 28 (i.e., direction "D"). Forward anchor 60 includes borehole retention assemblies 62 and a housing 64. The tractor 36 valve circuitry directs high pressure drilling fluid into and out of actuation assemblies which are a part of borehole retention assemblies 62. Borehole retention assemblies 62 may include wedge members that extend radially or expandable bladder-like grippers. The introduction of drilling fluid causes borehole retention assemblies 62 to extend/inflate and engage borehole wall 26. Borehole retention assemblies 62 disengage borehole wall 26 when the valve circuitry discharges the drilling fluid into the annulus 25. In a similar manner, aft anchor 70 engages borehole wall 26 while aft thruster 100 urges tube 50 downhole towards well bottom 28. Like forward anchor 60, aft anchor 70 includes borehole retention assemblies 72 and a housing 74.

Forward thruster 80 generates a thrusting force that urges bit 30 downhole against the well bottom 28. Forward thruster 80 includes a cylinder member 82, a piston head 90, a closure member 92 and a valve assembly (not shown). Cylinder member 82 surrounds and freely slides along tube 50 and is a barrel-shaped member having a forward end 83, an interior chamber 84, and an aft end 85. Closure member 92 is received within forward end 83 of cylinder member 82 to seal interior chamber 84. Piston head 90 is fixed onto tube medial portion 52 and is positioned within chamber 84 to divide chamber 84 into a power section 86 and a reset section 88. Piston head 90 begins its stroke within chamber 84 next to cylinder aft end 85 and completes its stroke next to cylinder forward end 83. The valve circuitry initiates a stroke by injecting or "spurting" pre-determined amounts of drilling fluid into the power section 86 for a finely controlled rate of advancement. When piston head 90 completes its stroke, i.e., reaches forward end 83, the valve assembly directs drilling fluid into reset section 88 to urge piston head 90 back to its original position.

Aft thruster 100 generates the thrusting force that urges bit 30 downhole against the well bottom 28 in generally the same manner as forward thruster 80. Aft thruster 100 includes a cylinder 102, a piston head 110, a closure member 112, and associated valve assemblies (not shown). Cylinder member 102 surrounds and freely slides along tube 50. Cylinder member 102 is a barrel-shaped member having an forward end 103, an interior chamber 104, and an aft end 105. Closure member 112 is received by aft end 105 of cylinder member 102 to seal interior chamber 104. Piston head 110 mounts directly onto tube medial portion 52 and is positioned within chamber 104 to divide chamber 104 into a power section 106 and a reset section 108. Piston head 110 begins its stroke within chamber 104 next to cylinder aft end 105 and completes its stroke next to cylinder forward end 103. The valve assembly initiates a stroke by directing drilling fluid into the power section 106. When piston head 110 has completed its stroke, i.e., reached forward end 103, the valve assembly directs drilling fluid into reset section 108 to urge piston head 110 back to its original position.

Figure 4A:
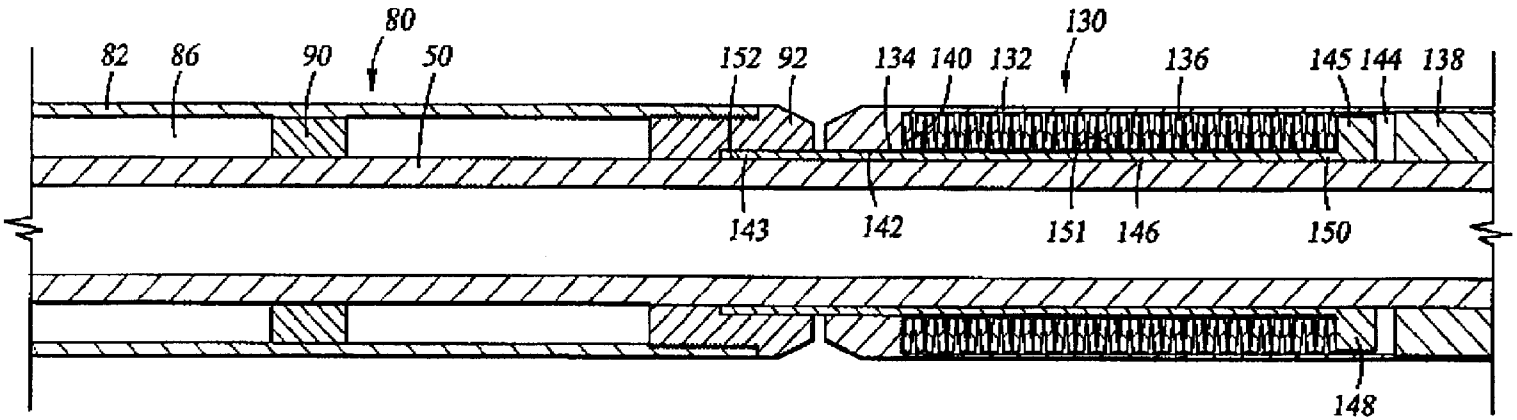
FIG. 4A is a cross-sectional view of a forward thrust controller constructed in accordance with the preferred embodiment.

Referring now to FIGS. 3A and 4A, forward thrust controller 130 controls the thrust generated by forward thruster 80. Forward thrust controller 130 includes a housing 132, a retainer 134 and at least one spring 136. Housing 132 includes first end 138, a back shoulder 140 forming an annular area 142 with tube 50, and a cavity 144. The cavity 144 is not sealed and although it initially preferably contains a high temperature grease, fluids such as annular drilling fluids may enter the cavity 144 during operation. Housing first end 138 is attached to forward anchor housing 64 (FIG. 3A) via a threaded connection or other suitable means. Retainer 134 transmits thrust between forward thruster 80 and spring 136. Retainer 134 includes a sleeve 146 and a collar 148 which are disposed around tube 50 and within housing cavity 144 in a piston-cylinder fashion. Sleeve 146 is generally a tubular member having a first end 143 and a second end 145 having collar 148. Sleeve 146 presents an outer surface 151 that is adapted to seat spring 136. First end 143 of sleeve 146 extends through the annular area 142 of back shoulder 140 and is attached to closure member 92 of forward thruster 80. Spring 136 on sleeve 146 is disposed between back shoulder 140 and collar 148.

When hydraulic pressure is applied on piston head 90 in power section 86, tube 50, which is attached to piston head 90, moves within thruster 80. Cylinder member 82, which is attached to forward anchor 60 via forward thrust controller 130, remains stationary as tube 50 moves within thruster 80. Should the bit 30 attached to tube 50 become stalled such as due to torque demand on the bit and mud motor, tube 50 will stop its forward movement. Also, tube 50 may stop its forward movement due to an excessive amount of "U" direction drag force from borehole wall 26 on tube 50. Because piston head 90 no longer can move, the hydraulic pressure will cause cylinder member 82 to move in a direction generally away from bit 30. As cylinder member 82 moves relative to forward anchor 60, collar 148 on sleeve 146 slides towards back shoulder 140 and compresses spring 136 between back shoulder 140 and collar 148.

Spring 136 absorbs the energy associated with an undesired increase in the thrust developed by forward thruster 80. Spring 136 is disposed about sleeve 146 and is compressed against back shoulder 140 by collar 148. The capacity of spring 136 to absorb energy depends, in part, on the spring constant of the material forming the spring, the number of springs, and the diameter of the springs. It will be appreciated that springs, such as Belleville springs, are a relatively reliable and inexpensive biasing mechanism capable of absorbing bursts of increased thrust. Other methods utilizing coiled springs, compressible fluids, or other means may also be used in other circumstances.

It can be seen that a resilient connection is established between forward borehole retention assembly 62 and cylinder member 82. Under normal operating conditions, this connection has a first state wherein a substantially solid connection is provided. Under overthrust conditions, this connection becomes resilient and allows cylinder member 82 to slide axially relative to forward borehole retention assembly 62 provided that the spring force of spring 136 is overcome.

Figure 4B:
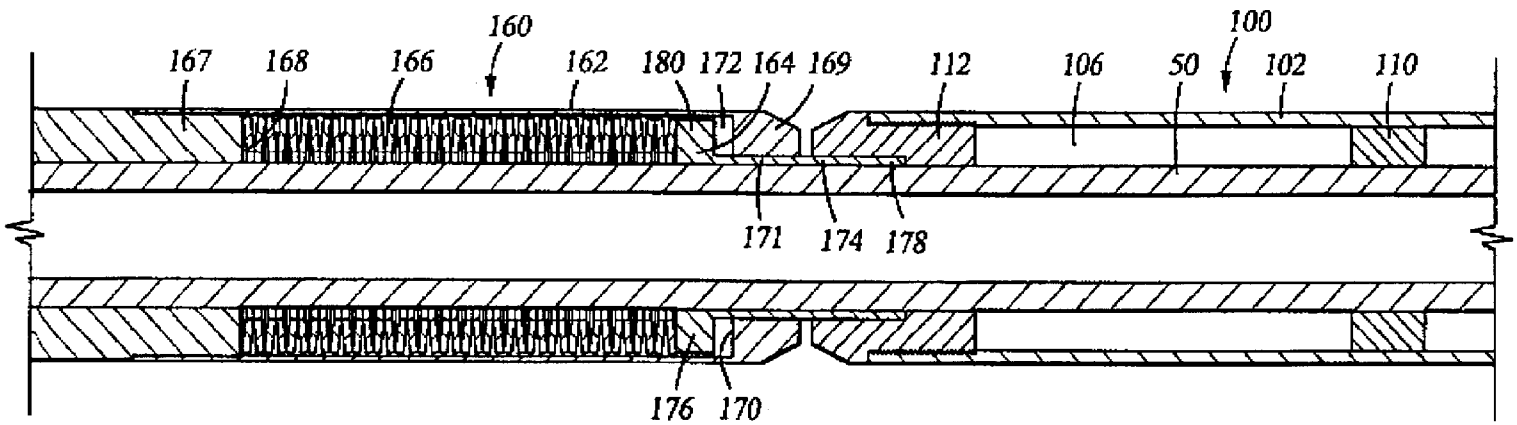
FIG. 4B is a cross-sectional view of an aft thrust controller constructed in accordance with the preferred embodiment.

Referring now to FIGS. 3B and 4B, aft thrust controller 160 modulates the thrust generated by aft thruster 100. Similar to the construction of forward controller 130, aft thrust controller 160 includes a housing 162, a retainer 164, and at least one spring 166. Housing 162 includes a first end 167 forming a first shoulder 168, and a second end 169 forming a second shoulder 170 that forms an annular area 171 with tube 50, and a cavity 172. The cavity 172 is not sealed and although it initially preferably contains a high temperature grease, fluids such as annular drilling fluids may enter the cavity 172 during operation. Housing first end 167 is connected with aft anchor housing 74 (FIG. 3B) via a threaded connection or other suitable means. Retainer 164 transmits thrust to and from aft thruster 100 and spring 166. Retainer 164 includes a sleeve 174 and a collar 176 which are disposed around tube 50 and within housing cavity 172 in a piston-cylinder fashion. Sleeve 174 is generally a tubular member having a first end 178 and a second end 180 having collar 176. First end 178 of sleeve 174 extends through the annular area 171 and is connected to closure member 112 of aft thruster 100.

When hydraulic pressure is applied on piston head 110 in power section 106, tube 50, which is attached to piston head 110, moves within aft thruster 100. Cylinder member 102, which is attached to aft anchor 70 via aft thrust controller 160, remains stationary as tube 50 moves within aft thruster 100. Should the bit 30 attached to tube 50 become stalled such as due to encountering slow drilling formation or formation that requires higher torque to rotate the bit or an excessive amount of drag force, tube 50 will stop its forward movement. Because piston head 110 can no longer move, the hydraulic pressure will cause cylinder member 102 to move in a direction generally away from bit 30. As cylinder member 102 moves relative to aft anchor 70, collar 176 on sleeve 174 slides towards first shoulder 168 and compresses spring 166 between first shoulder 168 and collar 176.

Spring 166 is formed in substantially the same manner as spring 136 of forward controller 130 and will not be discussed in further detail.

It can be seen that a resilient connection is established between aft borehole retention assembly 72 and cylinder member 102. Under normal operating conditions, this connection has a first state wherein a substantially solid connection is provided. Under overthrust conditions, this connection becomes resilient and allows cylinder member 102 to slide axially relative to aft borehole retention assembly 72 provided that the spring force of spring 166 is overcome.

Referring again to FIGS. 2, 3A, and 3B, under one mode of operation, the valve circuitry sequentially energizes the components of tractor 36 to impart a thrust on tube 50. The sequence of this thrusting action has a first step wherein the forward anchor 60 and thruster 80 are energized and a second step wherein the aft anchor 70 and thruster 100 are energized.

During the first step, the valve circuitry directs hydraulic fluid into forward anchor 60 to actuate borehole retention assembly 62. While forward anchor 60 engages borehole wall 26 (FIG. 2), valve circuitry injects hydraulic fluid into power section 86 of forward thruster 80. Under normal conditions, the hydraulic pressure in power section 86 works against piston head 90 to drive piston head 90 and connected tube 50 downhole in direction "D." Once piston head 90 completes its stroke within chamber 84, the valve circuitry de-actuates forward borehole assembly 62 and directs drilling fluid into reset section 88 to reset piston head 90 within chamber 84.

The second step, which may overlap with the conclusion of the first step, begins with actuating aft anchor 70 causing borehole retention assembly 72 to engage borehole wall 26. At the same time, the valve circuitry injects fluid into power section 106 of aft thruster 100. With aft anchor 70 engaged, the hydraulic pressure in power section 106 drives piston head 110 and connected tube 50 downhole in direction "D." Once piston head 110 completes the stroke within chamber 104, hydraulic fluid is directed into reset section 108 to reset piston head 110 within chamber 104 and the actuator assembly of borehole retention assembly 72 of aft anchor 70 to disengage from borehole wall 26. Thereafter, the operation repeats in substantially the same steps.

In the preferred embodiment, controllers 130 and 160 are actuated when tube 50 encounters difficulty in moving downhole in direction "D." This can happen when attempting to drill through a particularly slow drilling formation or formation that causes an increase in the torque required to turn the drill bit 30 or when there is an excessive amount of drag force on tube 50. In either situation, the mud motor may unintentionally and nearly instantaneously raise the upstream differential pressure.

As described above, during the first step of the tube movement cycle, forward anchor 60 engages borehole wall 26 (FIG. 2) while high pressure drilling fluid is directed into power section 86. The drilling fluid injected into power section 86, however, has a pressure higher than the desired operating pressure. Although the increased hydraulic pressure in power section 86 cannot urge tube 50 downhole in direction "D," the resilient connection between cylinder 82 and controller housing 132 enables the hydraulic pressure in power section 86 to urge cylinder 82 uphole in direction "U." The axial motion of cylinder 82 and connected retainer 134 causes collar 148 to impart a compressive force on spring 136. If the hydraulic pressure in power section 86 exceeds the spring force of spring 136, then cylinder 82, retainer 134 and collar 148 will be displaced uphole in direction "U," causing the spring 136 to be compressed against back shoulder 140. This compression continues until the hydraulic pressure in power section 86 is absorbed by spring 136. Thus, it can be seen that the excess thrust, which is attributable to the increase in hydraulic pressure, that would have normally been transmitted to bit 30 via tube 50 has been redirected into spring 136.

It will be appreciated that spring 136 maintains a WOB on bit 30 until tube 50 can slide downhole in direction D. That is, while thruster 80 is energized, but not moving, spring 136 urges collar 148 downhole in direction D. Collar 148 transmits this thrust via sleeve 146 through closure member 92 to cylinder 82. This thrust is delivered through the generally non-compressed hydraulic fluid in chamber 86 to piston head 90 and ultimately through tube 50 to bit 30. Thus, the thrust delivered to bit 30 by tube 50 is that which is stored in spring 136, and not moving thruster 80.

Aft controller 160 operates in substantially the same manner as forward controller 130. In the event that tube 50 is prevented from movement downhole in direction "D" when hydraulic fluid is directed into power section 106, cylinder 102 is driven uphole in the "U" direction by the hydraulic pressure in power section 106. The movement of cylinder 102 also forces retainer 164 to move uphole in direction "U." This movement by retainer 164 causes collar 176 to compress spring 166 against housing interior shoulder 168. As before, the spring 166 remains compressed until the thrust generated by the hydraulic pressure in power section 106 is reduced. The hydraulic pressure is reduced either due to bit drill-off where the rate the hole is drilled is faster than tractor rate of advancement or due to the end of the stroke.

Preferably, springs 136 and 166 incorporate a certain level of pre-compression that urges sleeves 146, 174 and thrusters 80, 100 downhole in direction D. This pre-compression is preferably enough to minimize any type of play or axial movement of retainers 134, 164 within their respective housings. This pre-compression may also provide a limited amount of compression of the spring from WOB during normal operating conditions. Preferably, springs 136, 166 are sized to have the capacity to absorb as much thrust as can be generated in instances where an unusually slow drilling formation or formation that requires higher torque to rotate the bit is encountered by bit 30 or where there is an excessive amount of drag force on tube 50.

Figure 5A:
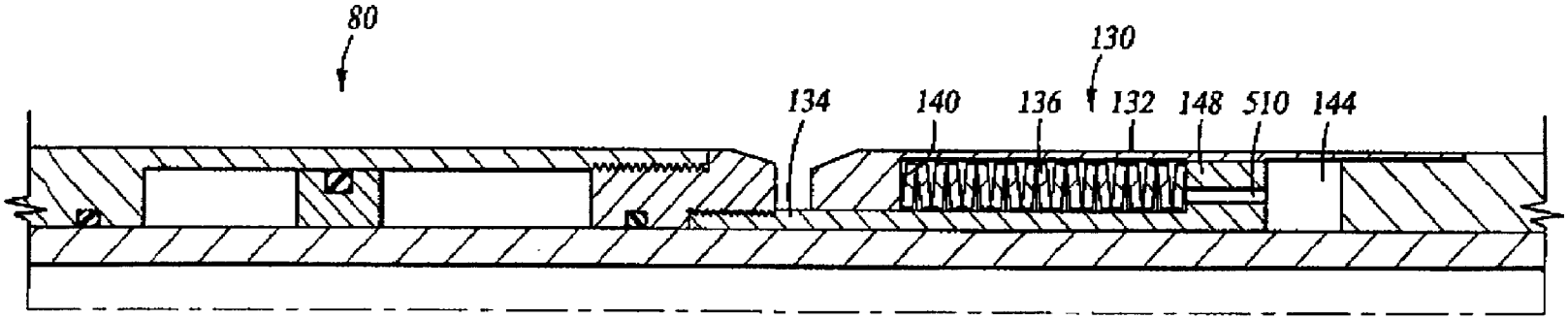
FIG. 5A is a top-half cross-sectional view of a first alternative embodiment of a forward thrust controller.
Figure 5B:
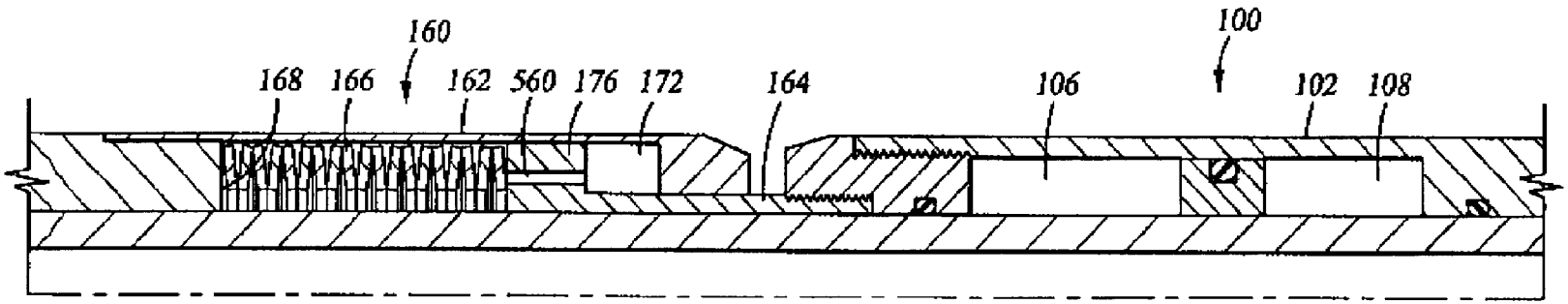
FIG. 5B is a top-half cross-sectional view of a first alternative embodiment of an aft thrust controller.

Referring now to FIGS. 5A and 5B, thrust controllers 130, 160 constructed in accordance with a first alternative embodiment will now be described. With the exception of the material discussed below, the first alternative embodiment comprises the same elements and operates in the same manner as the preferred embodiment discussed above. The first alternative embodiment thrust controllers 130, 160, however, additionally comprise a dampener with orifices 510, 560 located in the collars 148, 176 of the forward and aft thrust controller retainers 134, 164, respectively. Cavities 144 and 172 are filled with oil or other fluid. In operation, increased loading across the thrust controllers 130, 160 allows movement between the thrusters 80, 100 and the borehole retention assemblies 62, 72. Once the borehole retention assemblies 62, 72 release their grip on the borehole, however there is no external force across thrust controllers 130, 160. For example, with borehole retention assembly 62 no longer engaging borehole wall 26, spring 136, acting on back shoulder 140 of housing 132 connected to borehole retention assembly 62 and on collar 148 of retainer 134 connection to thruster 80, causes thruster 80 and borehole retention assembly 62 to move together as spring 136 de-compresses. Further, with borehole retention assembly 72 no longer engaging borehole wall 26, spring 166, acting on first shoulder 168 of housing 162 connected to borehole retention assembly 72 and on collar 176 of retainer 164 connected to thruster 100, causes thruster 100 and borehole retention assembly 72 to move apart as spring 166 de-compresses. Thrusters 80, 100 and borehole retention assemblies 62, 72 thus move in accordance with the force stored in the springs 136, 166. The orifices 510, 560 restrict the movement of the borehole retention assemblies 62, 72 by requiring the fluid to pass through the orifices 510, 560. The orifices 510, 560 thereby restrict movement so that borehole retention assemblies 62, 72 will not slam against the thrusters 80, 100 whenever the borehole retention assemblies 62, 72 release their grip on the borehole.

Figure 6A:
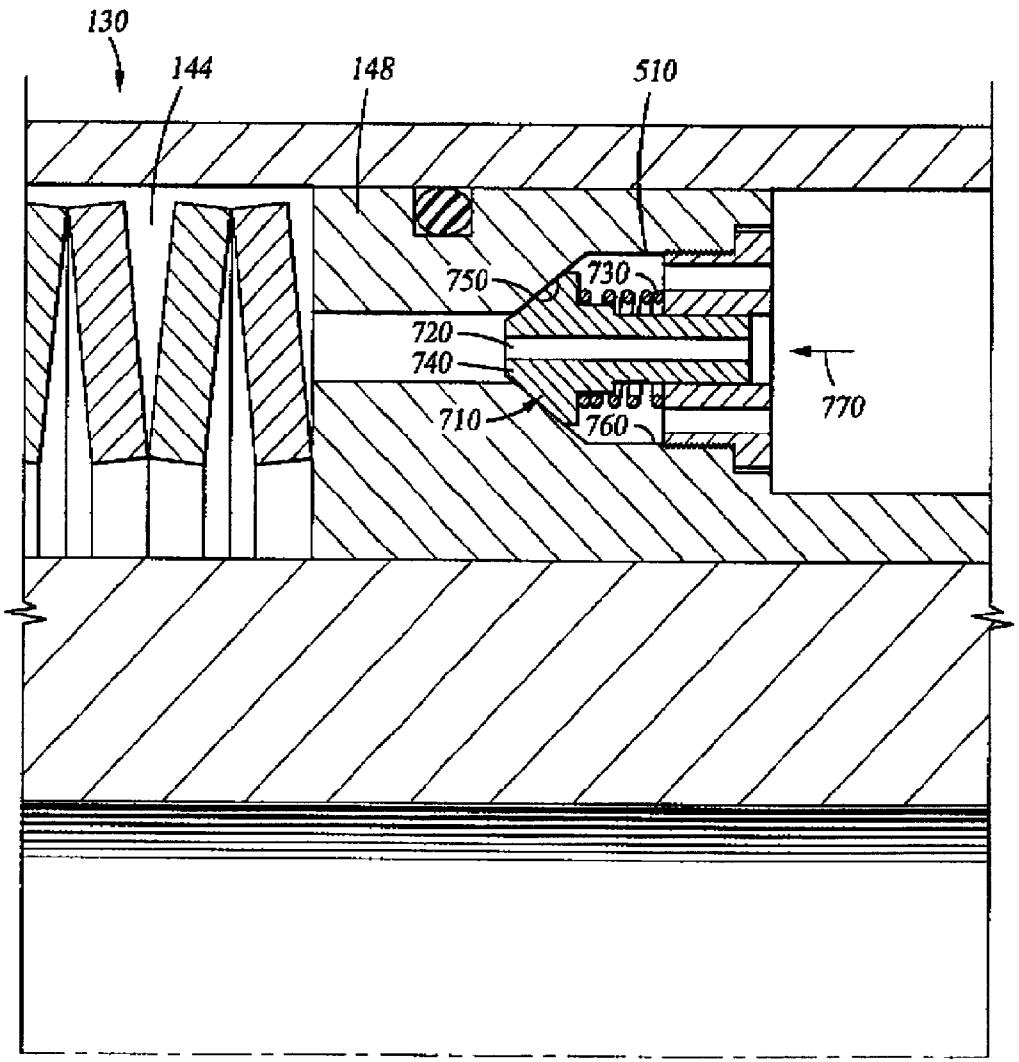
FIG. 6A is an enlarged cross-sectional view of a thrust controller retainer orifice in a first position constructed in accordance with the first and second alternative embodiments.
Figure 6B:
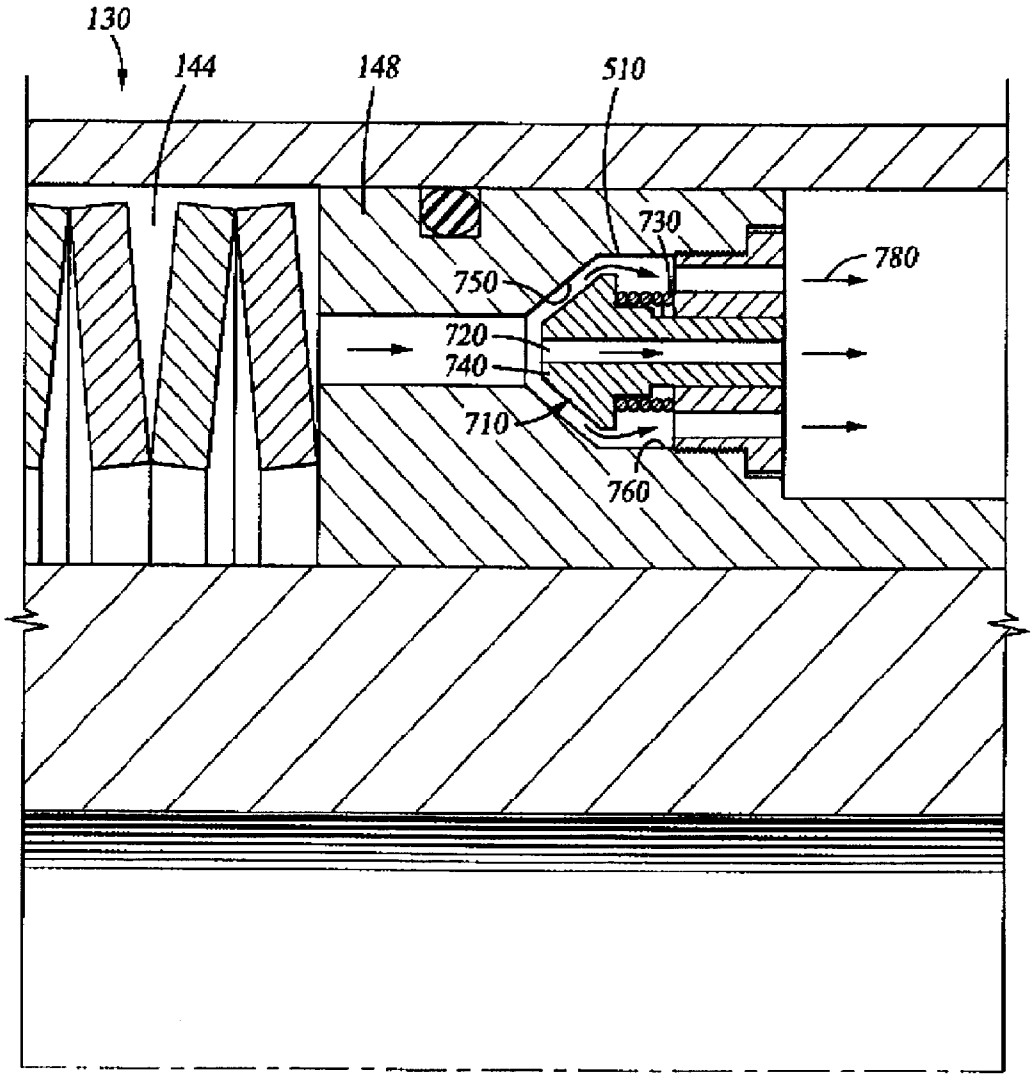
FIG. 6B is an enlarged cross-sectional view of a thrust controller retainer orifice in a second position constructed in accordance with the first and second alternative embodiments.

Referring now to FIGS. 6A and 6B, the orifices 510, 560 in collars 148, 176 respectively of the first alternative embodiment will now be discussed. Both of the orifices 510, 560 work in the same manner so that a description of orifice 510 in the forward thrust controller 130 will also describe orifice 560 in aft thruster controller 160. The orifice 510 has two positions, one maximum flow through orifice 510 and the other minimal flow therethrough. Flow through orifice 510 is maximized when spring 136 is being compressed to absorb energy and then is minimized when spring 136 is being de-compressed after borehole retention assembly 62 disengages borehole wall 26. This is done so that whenever the thruster 130 moves the tractor 36 down against the bit 30 during drilling, the movement of the thruster controller 130 and its ability to absorb load is not hampered by the orifice 510.

The orifice 510 is biased toward the minimal flow position. The orifice 510 can be biased several ways and still remain within the spirit of the first alternative embodiment. One way is to have a spring biased piston 710 with a hole 720 through its center axis. A spring 730 loads the piston head 740 against a shoulder 750 that is the transition between diameters in a through hole 760 in the thrust controller collar 148. Fluid flow in the direction 770 that increases the thrust controller cavity 144 in volume causes the piston head 740 to seat more securely against the through hole inside shoulder 750. This allows flow only through the small hole 720 through its center axis. This is shown in FIG. 6A. Fluid flow in the direction 780 that maximizes flow through orifice 510 pushes against the head of the piston 740 and biasing spring 730, moving the piston head 740 away from the shoulder 750, thereby increasing the flow area. This is shown in FIG. 6B.

Figure 7A:
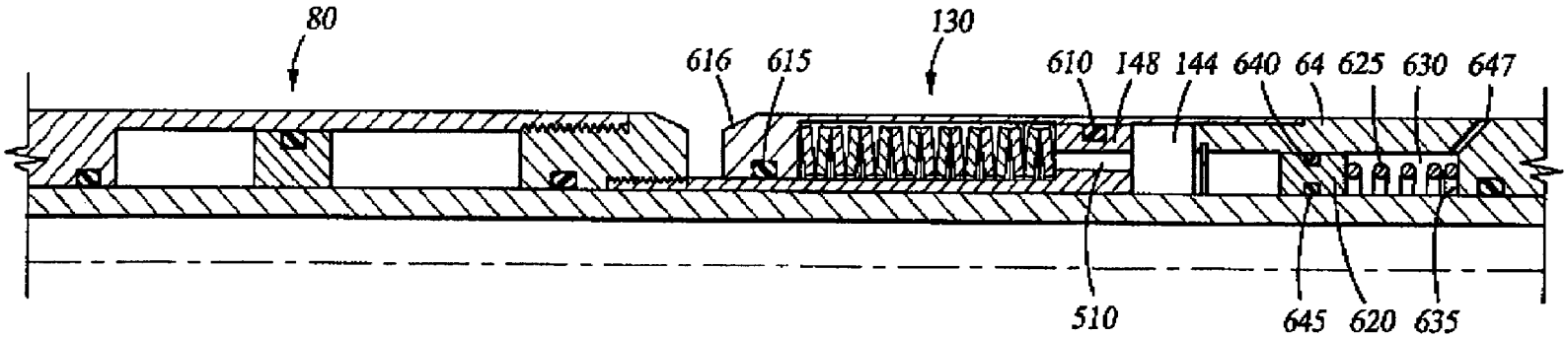
FIG. 7A is a top-half cross-sectional view of a second alternative embodiment of a forward thrust controller.
Figure 7B:
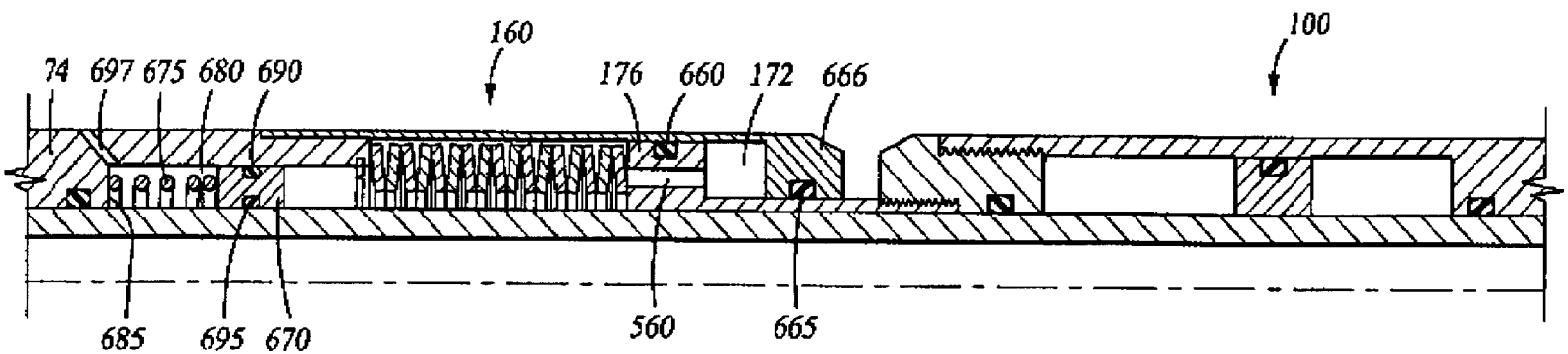
FIG. 7B is a top-half cross-sectional view of a second alternative embodiment of an aft thrust controller.

Referring now to FIGS. 7A and 7B, thrust controllers 130, 160 constructed in accordance with a second alternative embodiment will now be described. With the exception of the material discussed below, the second alternative embodiment comprises the same elements and operates in the same manner as the preferred embodiment discussed above. The second alternative thrust controllers 130, 160, however, also comprise a dampener with orifices 510, 560 similar to those discussed above in the first alternative embodiment. The second alternative embodiment thrust controllers 130, 160 additionally comprise collar seals 610, 660 on the forward and aft retaining collars 148, 176, respectively. The collars 148, 176 are sealed so that movement between the forward and aft thrusters 80, 100 and the forward and aft borehole retention assemblies (not shown) forces fluid flow through the orifices 510, 560. The second alternative thrust controllers 130, 160 also comprise housing seals 615, 665 on the exterior portions 616, 666 of the forward and aft housings 64, 74. Thus, unlike the preferred embodiment, the cavities 144, 172 are sealed to the outside environment inside the borehole 26. Preferably, the cavities 144, 172 are filled with a hydraulic fluid or high temperature grease, both fluids with low viscosity. Thrust controllers 130, 160 additionally comprise forward and aft biased volume compensator pistons 620, 670 located in enlarged diameter portions of the ends of forward and aft housings 64, 74 respectively. These pistons 620, 670 are biased by springs 625, 675 located in compensator cavities 630, 680 between the compensator pistons 620, 670 and the forward and aft compensator cavity shoulders 635, 685. The compensator cylinders 620, 670 are sealed with compensator seals 640, 645, 690, 695 to prevent fluid flow into the compensator cavities 630, 680. Retainer rings retain pistons 620, 670 in the enlarged diameter portions.

The housing seals 615, 665, collar seals 610, 660, and compensator seals 640, 645, 690, 695, form closed systems within the thrust controller cavities 144, 172. As closed systems, the volume in cavities 144, 172 remains somewhat constant. With a constant volume, movement of retaining collars 148, 176 changes the pressure in the volumes on either side of the collars 148, 176 that hinders movement of the retaining collars 148, 176. This is because the fluid in controller cavities 144, 172 is not able to stabilize through the orifices 510, 550 quickly enough to balance the changes in volume and pressure on either side of the collars 148, 176. To relieve the hindrance of these volume changes, the compensator pistons 620, 670 adjust to account for the changes in volume on either side of the collars 148, 176. So as to not hinder movement of the compensator pistons 620, 670 with a similar pressure, the compensator cavities 630, 680 communicate with the environment outside the housings 64, 74 through ports 647, 697.

Figure 8A:
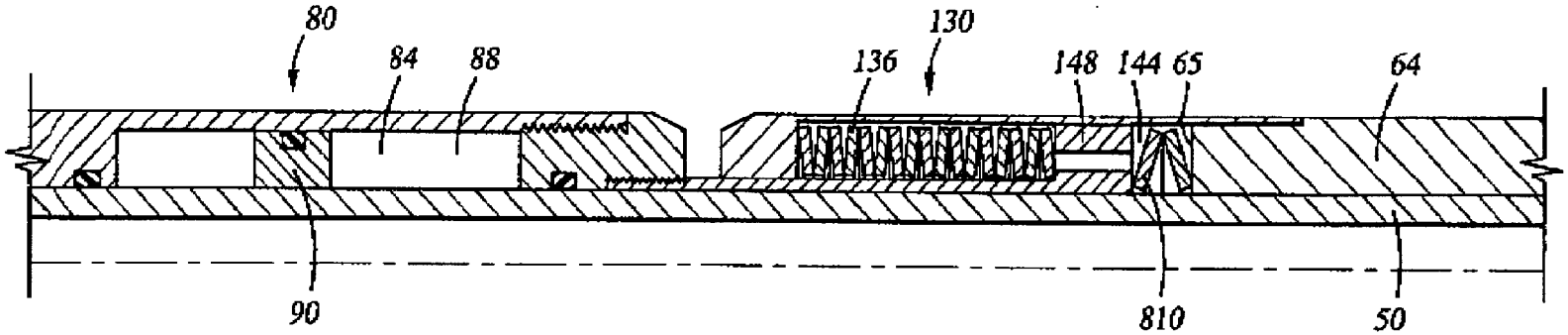
FIG. 8A is a top-half cross-sectional view of a third alternative embodiment of a forward thrust controller.
Figure 8B:
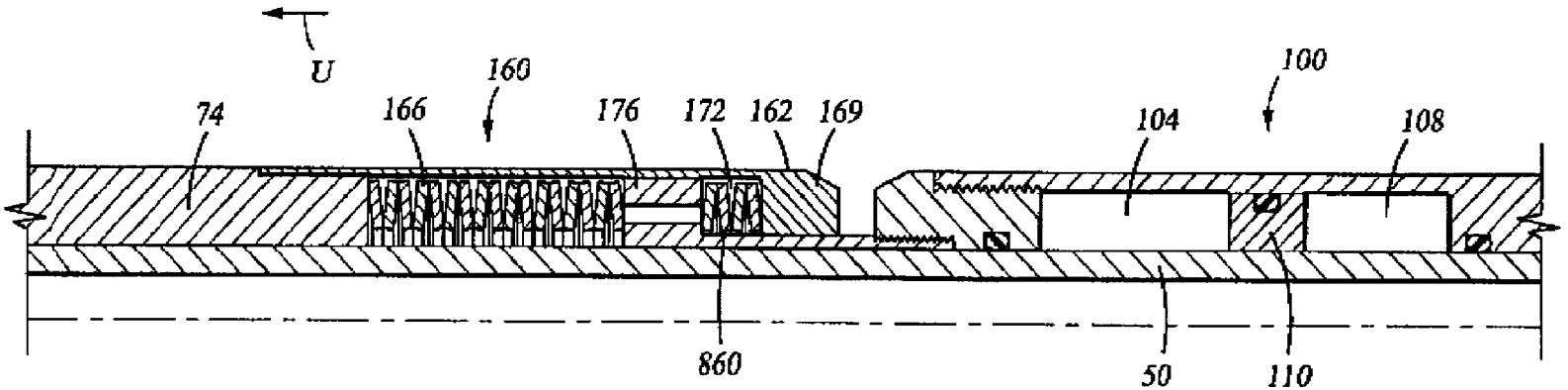
FIG. 8B is a top-half cross-sectional view of a third alternative embodiment of an aft thrust controller.

Referring now to FIGS. 8A and 8B, forward and aft thrust controllers 130, 160 constructed in accordance with a third alternative embodiment will now be described. With the exception of the material discussed below, the third alternative embodiment comprises the same elements and operates in the same manner as the preferred embodiment discussed above. The third alternative thrust controllers 130, 160, however, also comprise dampeners similar to those discussed above in the first or second alternative embodiments. The third alternative thrust controllers 130, 160 additionally comprise secondary biasing elements 810, 860. The first secondary biasing element 810 is located in the forward thrust controller cavity 144 between retainer collar 148 and the end 65 of housing 64. The second secondary biasing element 860 is located in the aft thrust controller cavity 172 between the collar 176 and the end 169 of housing 162. These secondary biasing elements 810, 860 are preferably springs that have limited movement, but can be other configurations without leaving the spirit of the third alternative embodiment.

When the tractor 36 is moving in the reverse direction U, or coming out of the borehole 22, fluid volume in the reset section 88 of the interior chamber 84 of the forward thruster 80 and in the reset section 108 of the interior chamber 104 of the aft thruster 100 is increased. This added volume places pressure on the forward and aft thruster pistons 90, 110, moving them and the tube 50 in the direction U. This operation moves the tube 50 out of the borehole 22 in the exact opposite method as was used to insert the tube 50 into the borehole 22. As with inserting the tube 50 into the borehole 22, the tube 50 incurs opposing forces as it moves out of the borehole 22. These forces work in the opposite direction as those discussed above that create an overthrust condition. With opposing forces on the tube 50 during the removal cycles of each thruster 80, 100, the forward and aft thrusters 80, 100 move in opposite directions than they would under overthrust conditions while moving the tube 50 into the borehole 22. Thus, when the elements are not preloaded by the secondary biasing elements, the forward thruster 80 moves closer to the forward housing 64 and the aft thruster 100 moves further away from the aft housing 74. This movement prevents the tractor 36 from realizing the full length of the thruster stroke due to movement between the thrusters 80, 100 and the housings 64, 74 under load. With the secondary biasing elements 810, 860, however, when the tractor 36 is moving in the reverse direction or coming out of the borehole 22, most of the length of the thruster strokes is realized in tractor 36 movement out of the borehole 22. This is because the secondary biasing elements 810, 860 reduce the total spring rate in upward direction but at minimal amount of movements so that the thruster strokes are not significantly reduced. The secondary biasing elements also reduce the total spring rate to protect the borehole retention assemblies (not shown) from high impact loads.

It should be understood that the present invention may be adapted to nearly any arrangement of devices. Although the present invention has been described as applied to a tractor having two thrusters, the present teachings may be, as an example, advantageously applied to a BHA arrangement that includes only one thruster. Further, the terms "U", uphole, "D", downhole, forward, and aft are terms merely to simplify the discussion of the various embodiments of the present invention. These terms, and other such similar terms, are not intended to denote any required movement or orientation with respect to the present invention.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. An apparatus disposed between a stationary member and a movable member, the movable member driving a shaft, comprising:

a first member adapted for connection to the stationary member;

a second member adapted for connection to the movable member;

a biasing member engaging said first and second members and having an actuated position and an unactuated position;

said biasing member being moved to said actuated position upon the movable member being unable to drive the shaft and allowing the movable member to move with respect to the stationary member.

2. The apparatus of claim 1 wherein said first and second members are in telescoping engagement.

3. The apparatus of claim 2 wherein said telescoping members form a housing for the biasing member.

4. The apparatus of claim 3 further comprising a secondary biasing member engaging the stationary member and the second member, the secondary biasing member being compressed upon the movable member being unable to drive the shaft and preventing the movable member to move with respect to the stationary member.

5. The apparatus of claim 1 wherein said biasing member is a spring that is compressed in said actuated position.

6. The apparatus of claim 1 wherein said stationary, movable, and second members form a common bore for receiving the shaft.

7. The apparatus of claim 1 where the stationary member becomes movable and further including a dampener between said first and second members dampening movement of said first and second members as said biasing member moves to said unactuated position.

8. The apparatus of claim 7 wherein said first and second members form a piston and cylinder, said piston dividing said cylinder into at least two chambers, said orifice being disposed in said piston restricting flow between said chambers as said piston moves within said cylinder.

9. The apparatus of claim 8 wherein said biasing member is disposed in one chamber and further including a spring disposed in the other chamber.

10. The apparatus of claim 8 wherein said biasing member is disposed in one chamber and further including a pressure compensation member disposed in the other chamber.

11. The apparatus of claim 5 wherein the first and second members form a sealed cavity housing the biasing member and the second member further includes an orifice resisting fluid flow into said sealed cavity.

12. The apparatus of claim 11 further comprising a compensator system in sealing engagement with the housing for movement in coordination with the movement of the second member such that the fluid pressure in the portion of the cavity that is between the compensator system and the second member remains essentially constant.

13. The apparatus of claim 12 wherein the compensator system includes a compensator piston in sealing engagement with the housing, a compensator spring in engagement with the compensator piston and the stationary member, and a port for fluid communication between an environment outside the stationary member and a compensator cavity between the compensator cylinder and the stationary member.

14. The apparatus of claim 1 wherein the second member includes an orifice for allowing fluid flow.

15. The apparatus of claim 14 wherein said orifice allows greater flow as said biasing member moves from said unactuated to said actuated position than when said biasing member moves from said actuated to said unactuated position.

16. The apparatus of claim 15 wherein the orifice is biased to allow more fluid flow through the orifice in one direction than another.

17. An apparatus for a downhole propulsion system for drilling a borehole with a bit, comprising:

an anchor member for anchoring the propulsion system;

a thrust member for driving the bit into the borehole;

a thrust control member having one end engaged with the anchor member and another end engaged with the thrust member;

the thrust control member allowing relative movement between the anchor member and thrust member.

18. The apparatus of claim 17 wherein the thrust control member includes a biasing member capable of compression.

19. The apparatus of claim 18 wherein the biasing member includes at least one Belleville spring.

20. The apparatus of claim 17 wherein the anchor member expands into engagement with a wall of the borehole to anchor the propulsion system.

21. The apparatus of claim 17 wherein the thrust member includes a cylinder member attached to the thrust control member and a piston member attached to a shaft.

22. A thrust controller for a bottom hole assembly (BHA) having an anchor, a thruster and a tube, the thruster configured to axially displace the tube and being susceptible to an overthrust condition when the thruster is unable to displace the tube, the thrust controller comprising:

an enclosure having an opening leading to a chamber, said enclosure fixed to the anchor;

a retainer reciprocally disposed within said chamber, said retainer having a first end projecting out of said enclosure opening and connecting with the thruster; and a biasing member associated with said retainer, said biasing member absorbing at least a portion of the thrust generated by the thruster during an overthrust condition.

23. The thrust controller of claim 22 wherein said biasing member absorbs substantially all of the thrust generated by the thruster during the overthrust condition.

24. The thrust controller of claim 22 wherein said biasing member includes a first state wherein biasing member has a predetermined level of pre-compression, said biasing member being in said first state while the thruster displaces the tube.

25. The thrust controller of claim 22 wherein said biasing member provides a thrust to the tube during an overthrust condition.

26. The thrust controller of claim 22 wherein said biasing member comprises at least one spring, and wherein said retainer further comprises a seating surface adapted to receive said springs and a collar retaining said springs on said retainer.

27. In a bottom hole assembly having a first and second thruster, a first and second anchor, and a tube, the thrusters configured to axially displace the tube and being susceptible to an overthrust condition when the thrusters are unable to displace the tube, a thrust controller comprising:

a first thrust absorber associated with the first thruster, said first thrust absorber including a first enclosure being fixed to the first anchor, said first enclosure having an opening leading to a chamber, a first retainer reciprocally disposed within said first enclosure chamber, said first retainer having a first end projecting out of said first enclosure opening and connecting with the first thruster, and a first biasing member associated with said first retainer, said first biasing member absorbing at least a portion of the thrust generated by the first thruster during an overthrust condition; and a second thrust absorber associated with the second thruster, said second thrust absorber including a second enclosure being fixed to the second anchor, said second enclosure having an opening leading to a second chamber, a second retainer reciprocally disposed within said second enclosure chamber, said second retainer having a first end projecting out of said second enclosure opening and connecting with the second thruster, and a second biasing member associated with said second retainer, said second biasing member absorbing at least a portion of the thrust generated by the second thruster during an overthrust condition.

28. The thrust controller of claim 27 wherein said first and second biasing members absorb substantially all of the thrust generated by the first and second thrusters, respectively, during an overthrust condition.

29. The thrust controller of claim 27 wherein said first and second biasing members include a first state wherein said first and second biasing members have a pre-determined level of pre-compression, said first biasing member being in said first state while the first thruster displaces the tube, said second biasing member being in said first state while the second thruster displaces the tube.

30. The thrust controller of claim 27 wherein said first and second biasing members provide a thrust to the tube while the first and second thrusters respectively are in an overthrust condition.

31. The thrust controller of claim 27 wherein said first and second biasing members each comprise at least one spring, and wherein said first and second retainers each further comprise seating surfaces adapted to receive said at least one spring and collars retaining said at least one spring on said first and second retainers, respectively.

32. A method for controlling an overthrust condition in a bottom hole assembly (BHA) having a thruster configured to axially displace a tube, the thruster being susceptible to the overthrust condition when the thruster is unable to displace the tube, the method comprising: absorbing at least a portion of the thrust generated by the thruster during an overthrust condition.

33. The method of claim 32 wherein substantially all of the thrust generated by the thruster is absorbed.

34. The method of claim 32 wherein the thrust is absorbed by a biasing member.

35. The method of claim 32 further comprising configuring the biasing member to have a pre-compression when the thruster can displace the tube.

36. The method of claim 35 further comprising configuring the biasing member to provide a thrust to the tube while the thruster is in an overthrust condition.

37. The method of claim 32 wherein the thrust is absorbed by at least one spring.

38. A well tool comprising:

a tube;

an anchor having anchoring means for engaging a bore-hole wall;

a thruster associated with said anchor, said thruster having thrusting means for axially displacing said tube, said thruster having an overthrust condition during which said thruster applies a thrust to said tube but said thruster does not substantially displace said tube; and a thrust controller interposed between said anchor and said thruster, said controller being connected to said anchor and including a chamber, a retainer disposed within said chamber, said retainer having a central passage for receiving said tube and a first end connected to said thruster, said controller further including a biasing member associated with said retainer, said biasing member absorbing at least a portion of the thrust generated by the thruster during an overthrust condition.

39. The thrust controller of claim 38 wherein said biasing member absorbs substantially all of the thrust generated by the thruster during an overthrust condition.

40. The thrust controller of claim 38 wherein said biasing member includes a first state wherein said biasing member has pre-determined level of pre-compression.

41. The thrust controller of claim 38 wherein said biasing member provides a trust to the tube while the thruster is in an overthrust condition.

42. The thrust controller of claim 38 wherein said biasing member comprises at least one spring, and wherein said retainer further comprises a seating surface adapted to receive said springs and a collar retaining said springs on said retainer.

* * * * *